US007377216B2

(12) United States Patent
Simon et al.

(10) Patent No.: US 7,377,216 B2
(45) Date of Patent: May 27, 2008

(54) PRINTING MACHINE HAVING FIXED PAPER CYLINDER

(75) Inventors: Pierre Simon, Orleans (FR); Bernard Six, Olivet (FR)

(73) Assignee: Komori-Chambon S.A., Orleans (FR)

( * ) Notice: Subject to any disclaimer, the term of this patent is extended or adjusted under 35 U.S.C. 154(b) by 261 days.

(21) Appl. No.: 10/522,808

(22) PCT Filed: Jul. 31, 2003

(86) PCT No.: PCT/FR03/02428

§ 371 (c)(1),
(2), (4) Date: Jan. 31, 2005

(87) PCT Pub. No.: WO2004/012941

PCT Pub. Date: Feb. 12, 2004

(65) Prior Publication Data

US 2006/0075911 A1 Apr. 13, 2006

(30) Foreign Application Priority Data

Jul. 31, 2002 (FR) ..... 02 09721

(51) Int. Cl.
*B41F 9/01* (2006.01)

(52) U.S. Cl. ..... 101/142; 101/138; 101/181

(58) Field of Classification Search ..... None
See application file for complete search history.

(56) References Cited

U.S. PATENT DOCUMENTS

| | | | | |
|---|---|---|---|---|
| 2,965,023 | A * | 12/1960 | Boule et al. | 101/352.05 |
| 3,081,700 | A * | 3/1963 | Kieckhefer, Jr. | 101/177 |
| 3,633,504 | A | 1/1972 | Chambon | |
| 3,892,178 | A * | 7/1975 | Staamann | 101/177 |
| 4,141,293 | A * | 2/1979 | Corse | 101/181 |
| 4,462,311 | A * | 7/1984 | Armelin | 101/143 |
| 4,774,883 | A * | 10/1988 | Mailander | 101/137 |
| 5,878,666 | A * | 3/1999 | Schneider et al. | 101/217 |
| 2001/0037741 | A1 | 11/2001 | Franklin et al. | |

FOREIGN PATENT DOCUMENTS

| | | |
|---|---|---|
| DE | 548 192 | 4/1932 |
| DE | 1 499 073 | 12/1971 |
| DE | 199 37 783 | 2/2001 |
| DE | 101 60 734 | 7/2002 |
| EP | 1 101 611 | 5/2001 |

* cited by examiner

*Primary Examiner*—Jill E. Culler
(74) *Attorney, Agent, or Firm*—Young & Thompson

(57) ABSTRACT

The invention relates to a variable printing machine which is embodied in the form of at least two offset printing apparatus (1) and comprises a frame bearing an opposite cylinder against which a blanket (11) to be printed is pressed by a blanket drum. Printing ink is supplied to a printing cylinder which contacts the blanket drum by means of inking rollers. The inventive printing machine is characterized in the following: the opposite cylinder of each apparatus (1) is devoid of all rotatable transmissions; a levelling between two adjacent units which print one and the same blanket face (11) is embodied in such a way that said blanket is in contact with the blanket drums only.

19 Claims, 2 Drawing Sheets

PRINTING MACHINE HAVING FIXED PAPER CYLINDER

The present invention relates to an offset printing machine of variable format type making it possible to produce prints with low tool costs, able to pass from one format to another with a particularly reduced transformation time and by effecting a minimum waste of ink and of blanket to be printed.

Printing machines are known in the prior state of the art which are constituted by a plurality of offset apparatus disposed side by side in line, as described in U.S. Pat. No. 5,394,798 and which, by employing plate and blanket cylinders forming inserts, are in a position to print variable formats, but this to the detriment of a high tool manufacturing cost.

Variable format "flexo" printing machines are also known which are also constituted by a series of printing apparatus disposed in line, of which the printing cylinder is constituted by a tube easily extractable axially by means of a compressed air system also used on offset machines for changing the blankets. It is also known that the printing apparatus used on these "flexo" machines are provided with cylinders driven by independent motors allowing considerable suppleness in the course of use and making it possible to prepare certain apparatus for a new type of work while the other apparatus of the machine are in the course of functioning then, without stopping the printing machine, to relaunch the new apparatus and synchronize them with respect to one another so as to ensure a fresh printing. Of course, such machines make it possible to recondition the apparatus previously in movement in order to pass in the same way to the printing of fresh work.

Printing machines are also known, which are equipped with offset apparatus requiring only low tool costs, but which, due to the existence of a mobile paper cylinder as described in U.S. Pat. No. 5,351,616, do not allow, on certain apparatus, the passage from one format to another or the change of printing plate without stopping the machine.

Moreover, it is known that it is particularly interesting to have available a printing machine which makes it possible to effect a change of type of work, particularly of the printing form, in the course of functioning, without it being necessary, in order to pass from one work to another, to stop the machine, and this in order to reduce waste, particularly that of the blanket to be printed and the inks used, which waste does not fail to occur most of the time by reason of the variations in speed at the level of water/ink equilibrium encountered in the phases of stop or start when the speed of the machine is low, for example less than 30 m/min or the printing is not of good quality. It is also known that it is interesting to be able to change the ink of certain apparatus in masked time, i.e. while the machine is continuing to print with other apparatus.

The present invention has for its object to avoid the various drawbacks of the prior art set for hereinabove, by proposing an offset printing machine of the variable format type making it possible to produce prints with low tool costs, able to pass from one format to another, or from one type of printing to another, with a particularly reduced transformation time, which may, moreover, be a masked time, and by effecting a minimum of waste of the ink and of the blanket to be printed.

The present invention thus has for its object a variable format printing machine, of the type constituted by at least two offset printing apparatus, comprising a frame supporting a paper cylinder against which a blanket cylinder presses a blanket to be printed, the printing ink being supplied on a plate cylinder in contact with the blanket cylinder by inking rollers, characterized in that:

the paper cylinder of each apparatus is devoid of any drive in rotation, and is substantially fixed with respect to the frame, between two adjacent apparatus which print one and the same face of the blanket, the arrangement is such that this face is in contact only with the blanket cylinders.

According to the invention, the plate and blanket cylinders will preferably be provided with means for rendering them removable, and will present a diameter as a function of the format to be printed.

Each printing apparatus may comprise sub-assemblies grouping together the elements respectively associated with the inking rollers, the plate cylinder and the blanket cylinder, which will be slidably mounted on slideways of the frame under the action of motorization elements which will be fast with the latter so that each of these sub-assemblies is adapted to undergo a translation perpendicular to the axis of rotation of the cylinders.

Each printing apparatus may, moreover, comprise servo-control means able to adjust the position of the sub-assemblies with respect to the paper cylinder.

In a variant embodiment of the invention, each printing apparatus may comprise detection and safety means allowing two sub-assemblies to move apart from each other when the detection means detect an effort greater than a determined maximum value between their respective associated cylinders. These safety means may comprise a control logic for adjusting the offset of the cylinders with respect to one another.

According to the invention, the blanket cylinder and/or the plate cylinder and/or the inking rollers may be driven in rotation by independent motors servo-controlled electronically between themselves, which servo-control may be effected by a system of electric shafts.

The drive of the inking rollers in rotation may be ensured by a motor of which the speed will be servo-controlled so that the peripheral speed of each of these rollers is substantially equal to that of the plate and/or to the speed of displacement of the blanket.

The printing apparatus may be provided with a single composition roller of which the diameter will be constant and therefore independent of the format to be printed and which will be supplied with ink by at least four inking rollers.

According to a particularly interesting arrangement of the invention, at least one of the cylinders will be constituted by a removable sleeve, connected to a support cylinder. In a variant, the composition roller will, in functioning, be held at its two ends by two bearings, of which one will be provided with means allowing it, at stop, to retract so as to allow the extraction and positioning of a sleeve.

Particularly in order to allow an easy exchange of the sleeves disposed on the cylinders, at least one of the ends of at least one cylinder will be maintained embedded in a bearing fast with the frame, the other end being, in position of operation, in abutment on a mobile support, this mobile support being retractable into rest position, so that, in this position, the cylinder may be maintained in overhang by the bearing. The mobile support may comprise at least two abutments of one end of the cylinder and complementary abutment means applying the cylinder on these two abutments in order to hold it there. These two abutments may themselves be constituted by rotating elements. In a variant, the mobile support may in particular take the shape of a U. Finally, the complementary abutment means may be constituted by a pivoting lock controlled by a jack.

A form of embodiment of the present invention will be described hereinafter by way of non-limiting example, with reference to the accompanying drawings, in which.

Figure 1:
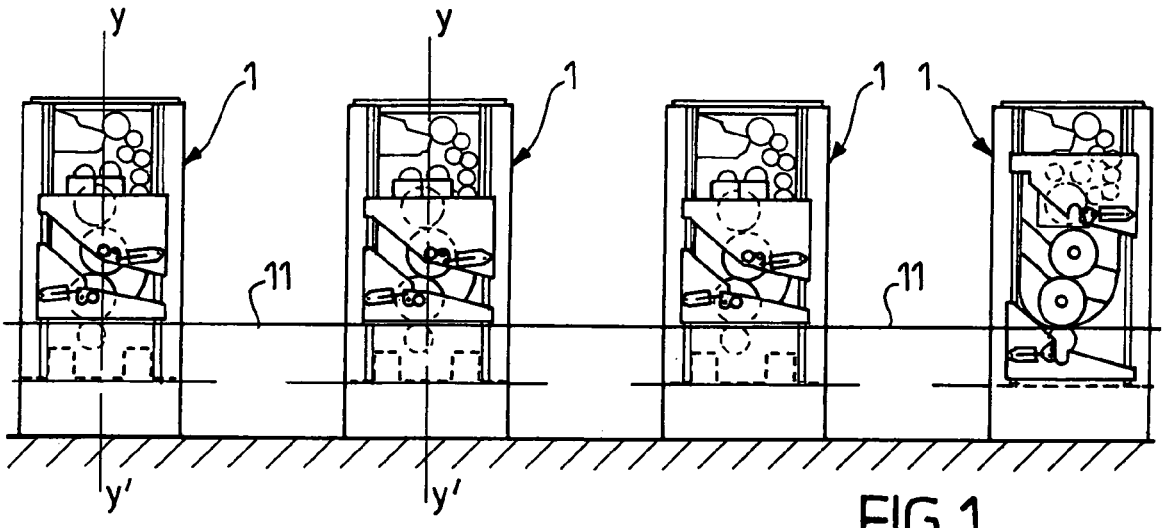
FIG. 1 is a schematic front view of a printing machine constituted by a series of four offset apparatus.

The printing machine according to the invention is constituted, as shown in FIG. 1, by four offset printing apparatus 1 allowing, for example, printing in quadrichromy.

Figure 2:
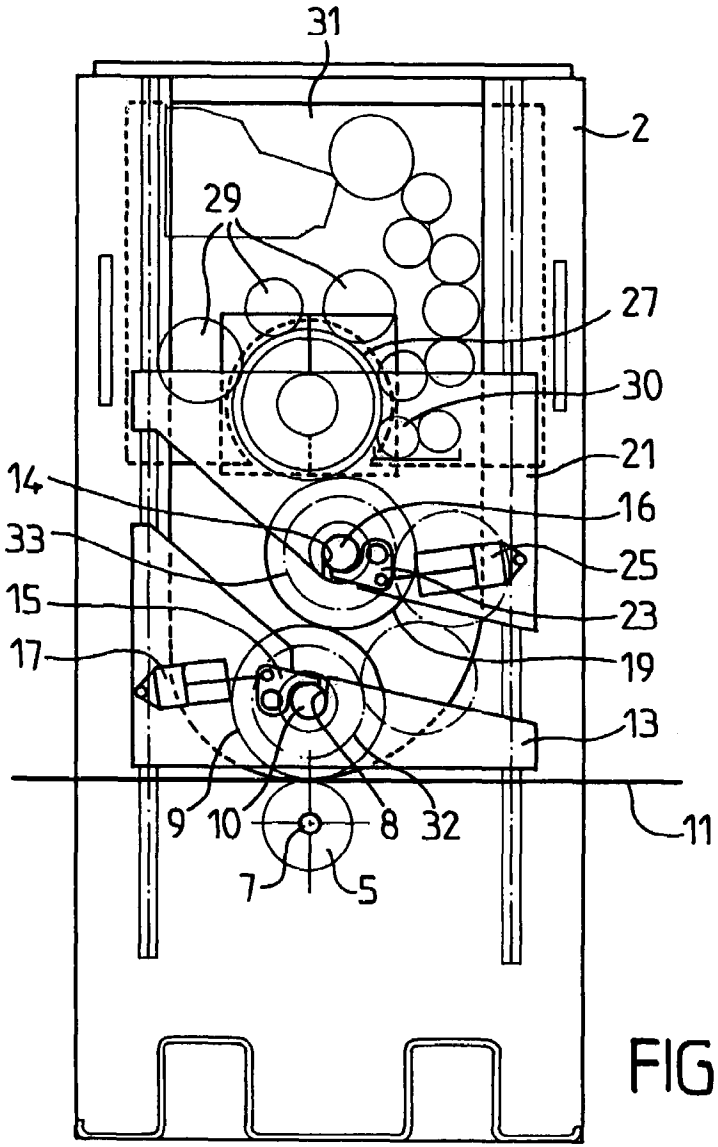
FIG. 2 is a schematic view in vertical transverse section of one of the offset apparatus constituting the printing machine, which is represented in small format printing position.

As shown in FIG. 2, each of these printing apparatus 1 is constituted by a frame 2 which can be easily positioned on the machine and which ensures hold of the different cylinders.

The apparatus thus comprises a paper cylinder 5 which is mounted free about the rotation shaft 7, this rotation shaft being substantially fixed with respect to the frame 2, i.e. its displacement in the vertical direction is at maximum only a few millimeters. This paper cylinder forms an integral part of the printing apparatus 1 and is not changed when one passes from one printing format to another. Furthermore, it is substantially fixed with respect to the frame of the apparatus.

The apparatus also comprises a blanket cylinder 9 which presses a blanket 11 to be printed against the paper cylinder 5. According to the invention, the arrangement of the plate cylinders 5 of the four apparatus 1 constituting the printing machine and the non-interchangeable nature of the plate cylinder with the format, mean that the blanket 11 is distributed in a straight line from the first to the last of the printing apparatus. Furthermore, according to the invention, the blanket 11 to be printed is fixed, or virtually fixed in position, this allowing the passage in masked time from one apparatus to another in order to pass from a given type of work on certain apparatus (for example a printing with a determined format), to another type of work (for example a different printing or with a different format) on other apparatus; This arrangement enables savings to be made concerning both the time of passage from one format to another, and the quantity of blanket and ink consumed during this change of work, as well as the carrying out of certain operations in masked time.

The posterior end of the rotation shaft 10 of the blanket cylinder 9 is embedded in a support bearing (end not shown in the drawing) and its anterior end is maintained in a bearing 8 in the form of a U open in its upper part which is hollowed in a mobile plate 13, downwardly retractable in position of rest or of intervention. The bearing 8 may be closed in its upper part by a pivoting lock 15 controlled by a jack 17. The bearing 8 and the lock system 15 are mounted on a vertically mobile carriage 13, this allowing it to be positioned with respect to the plate cylinder 5 as a function of its different diameters, themselves a function of the printing format.

The printing apparatus 1 also comprises a plate cylinder 19 which, like the blanket cylinder 9, has the posterior end of its rotation shaft 16 which is embedded in a support bearing (end not shown in the drawing) and its anterior end which is maintained in a bearing 14 in the form of an upturned U open in its lower part and which is hollowed in a mobile plate 21 upwardly retractable in position of rest or of intervention. The bearing 14 may be closed in its lower part by a pivoting lock 23 controlled by a jack 25. Like the blanket cylinder 9, the plate cylinder 19 is mounted on a carriage 21, which allows it to be positioned with respect to the latter as a function of the different diameters used. The blanket cylinder 9 and the plate cylinder 19 may thus be easily changed as a function of the printing formats.

The printing apparatus 1 also comprises a composition roller 27 which is supplied with ink by four inking rollers 29 and a dampening roller 30. The composition roller 27, as well as the inking rollers 29, and the dampening roller 30 are mounted on a carriage 31 which is vertically mobile with respect to the frame 2.

A control logic and servo-control means will make it possible to position the different carriages with respect to one another, and detection and safety means will allow them to move apart when detection means perceive an effort greater than a determined maximum value between the different respective cylinders.

According to the invention, the plate cylinder 19 as well as the blanket cylinder 9 may be of the type with added plate. I.e. they may be constituted by a base cylinder on the periphery of which is fixed a plate, for example by adhesion or by fixation from a system of slots.

This added plate or this added blanket may also be constituted by a thin sleeve which is fixed on the support cylinder by any appropriate fixation means.

Figure 4:
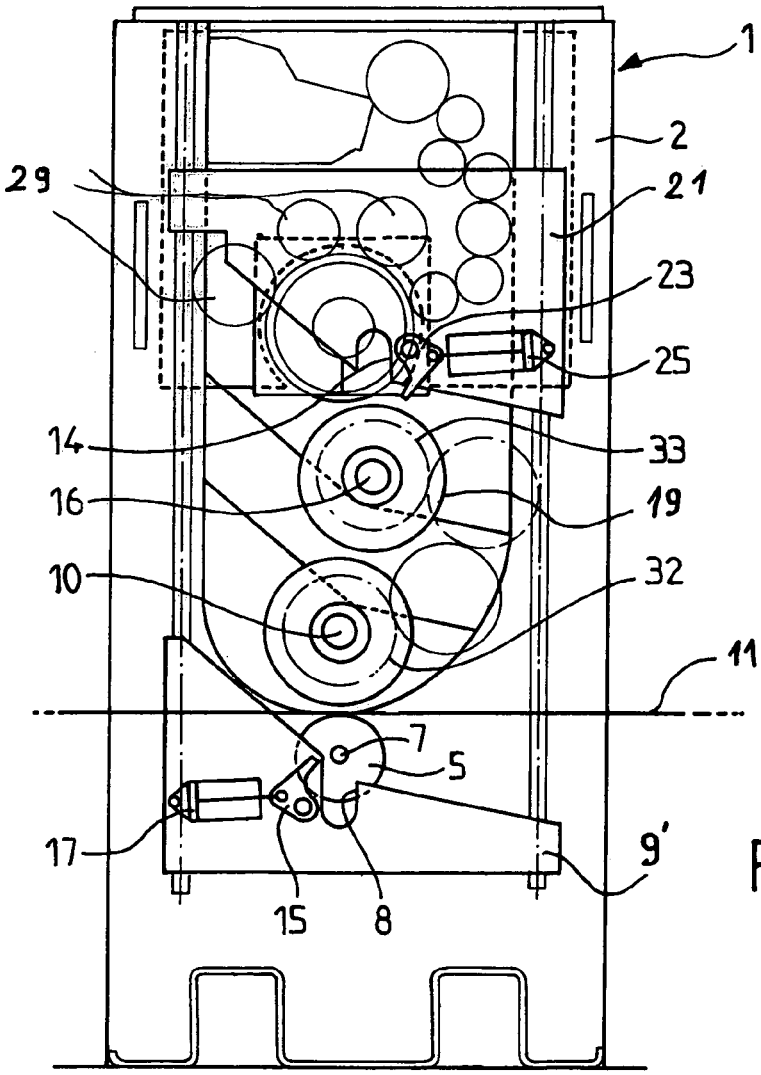
FIG. 4 is a schematic view in transverse cross section of the same apparatus shown in offset position, and the bearings of the plate and blanket cylinders being open and disengaged in order to allow the sleeves to axially emerge from the plate and blanket cylinders.
Figure 3:
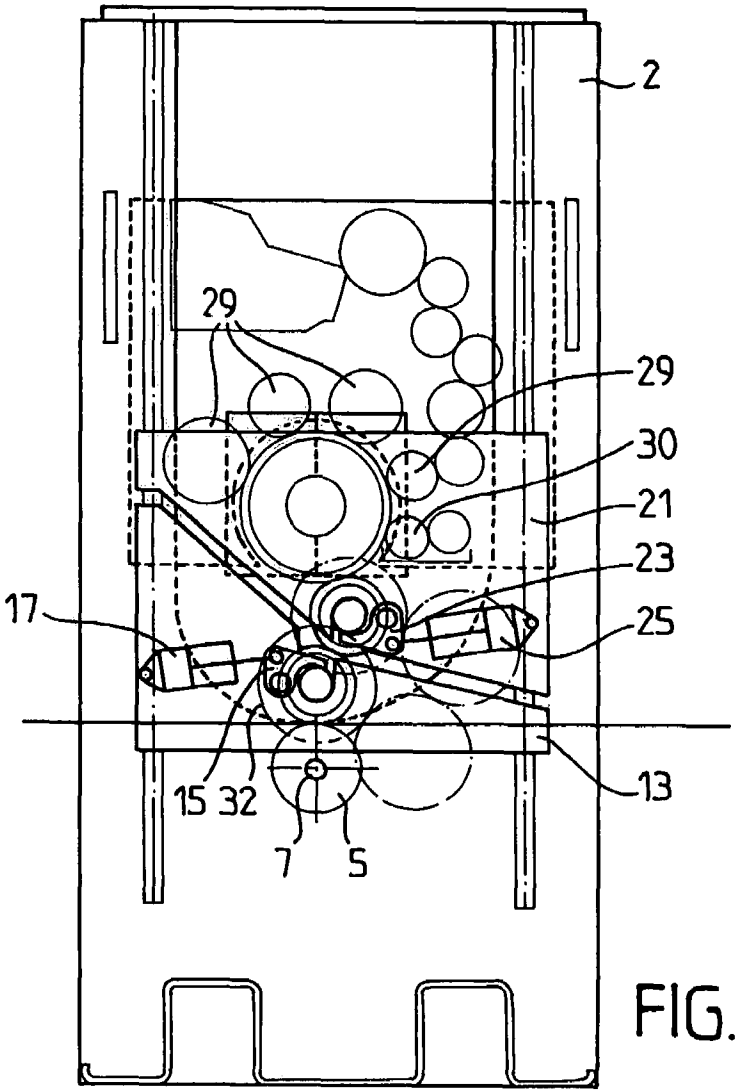
FIG. 3 is a schematic view in vertical transverse section of the same printing apparatus shown in large format printing position.

This plate or this blanket are removable without the user being obliged, for all that, to dismantle the support part of the plate or blanket cylinder. To that end, as shown in FIG. 4, the frontal bearing-carrier plate moves, downwardly concerning the blanket cylinder 9, and upwardly concerning the plate cylinder 19, after the locks 15 and 23 have been pivoted into position of opening by means of the respective jacks 17 and 25. In this position, shown in FIG. 4, the cylinders are solely maintained in overhang by their respective posterior bearings. In this way, the user has access to the sleeve or to the thin plate depending on the cylinder considered and may extract them axially from the cylinder-carrier part, in order to replace it by another appropriate plate or blanket or another sleeve of different format.

The same arrangement may be made for the composition roller 27.

Drive of the blanket cylinder 9 and of the plate cylinder 19 in rotation may be ensured, as shown in FIG. 2, by a common drive system ensuring the synchronization of these two cylinders with respect to each other, and which is constituted by pinions 32 and 33.

According to the invention, drive of these cylinders in rotation may also be ensured with the aid of independent electric motors and their synchronization with respect to each other and with respect to the rest of the machine ensured by means of a system of electrical shafts which ensure maintenance of their positioning in angular marking.

Drive of the inking rollers 29 is preferably effected by a motor whose speed is servo-controlled so that the peripheral speed of these inking rollers is substantially equal to the peripheral speed of the plate and of the blanket to be printed.

Each apparatus is provided with means making it possible, when the blanket cylinder is no longer in contact with the blanket 11 to be printed, to be slowed down and stopped independently of the rest of the machine, in other words of the other printing apparatus.

After the replacement of the desired elements, namely the plate and/or the blanket and/or the composition roller, the apparatus may be accelerated and synchronized in speed and in position with respect to the rest of the machine so that, when its blanket cylinder is placed under pressure with the blanket 11, the assembly is in perfect synchronization.

The offset printing apparatus will preferably comprise one sole composition roller composed of a tube lined with a supple coating mounted on a shaft which is easily extractable axially by an air cushion system between its interior surface and the exterior surface of its shaft.

The invention claimed is:

1. Variable format printing machine, comprising:

at least two offset printing apparatus (1), each apparatus comprising a frame (2) supporting a paper cylinder (5) against which a blanket cylinder (9) presses a blanket (11) to be printed, the printing ink being supplied on a plate cylinder (19) in contact with the blanket cylinder (9) by inking rollers, wherein, the paper cylinder (5) of each apparatus (1) is devoid of any drive in rotation and is substantially fixed with respect to the frame (2), and between two adjacent apparatus (1) which print one and the same face of the blanket (11), the arrangement is such that this face is in contact only with the blanket cylinders (9), characterized in that the drive of the inking rollers (29) in rotation is ensured by a motor of which the speed is servo-controlled so that the peripheral speed of each of these rollers is substantially equal to that of the plate and/or to the speed of displacement of the blanket (11).

2. Machine according to claim 1, wherein, the plate (19) and blanket (9) cylinders are provided with means for rendering the plate and blanket cylinders removable, and accepting plate and blanket cylinders of variable diameters in order to present a diameter as a function of the format to be printed.

3. Machine according to claim 1, characterized in that each printing apparatus comprises sub-assemblies grouping together the elements respectively associated with the inking rollers (29), the plate cylinder (19) and the blanket cylinder (9), which are slidably mounted on slideways of the frame (2) under the action of motorization elements which are fast with the latter so that each of these sub-assemblies is adapted to undergo a translation perpendicular to the axis of rotation of the cylinders.

4. Machine according to claim 3, characterized in that the composition roller (27) and the inking rollers (29) associated therewith form part of the same sub-assembly.

5. Machine according to claim 4, characterized in that the dampening roller (30) is disposed on the aforementioned sub-assembly.

6. Machine according to claim 1, characterized in that the printing apparatus (1) are provided with a single composition roller (27) of which the diameter is constant and independent of the format to be printed and which is supplied with ink by at least four inking rollers (29).

7. Machine according to claim 1, characterized in that at least one of the cylinders (9, 19, 27) is constituted by a removable sleeve, connected to a support cylinder.

8. Machine according to claim 7, characterized in that the composition roller is, in functioning, held at its two ends by two bearings, of which one is provided with means allowing it, at stop, to retract so as to allow the extraction and positioning of a sleeve.

9. Machine according to claim 1, characterized in that the positioning of the paper cylinders (5) of the printing apparatus (1) is such that the blanket (11) to be printed is distributed in a straight line inside the machine.

10. Variable format printing machine, comprising:

at least two offset printing apparatus (1), each apparatus comprising a frame (2) supporting a paper cylinder (5) against which a blanket cylinder (9) presses a blanket (11) to be printed, the printing ink being supplied on a plate cylinder (19) in contact with the blanket cylinder (9) by inking rollers, wherein, the paper cylinder (5) of each apparatus (1) is devoid of any drive in rotation and is substantially fixed with respect to the frame (2), and between two adjacent apparatus (1) which print one and the same face of the blanket (11), the arrangement is such that this face is in contact only with the blanket cylinders (9), characterized in that each printing apparatus comprises sub-assemblies grouping together the elements respectively associated with the inking rollers (29), the plate cylinder (19) and the blanket cylinder (9), which are slidably mounted on slideways of the frame (2) under the action of motorization elements which are fast with the latter so that each of these sub-assemblies is adapted to undergo a translation perpendicular to the axis of rotation of the cylinders, and characterized in that each printing apparatus comprises servo-control means able to adjust the position of the sub-assemblies with respect to the paper cylinder (5).

11. Variable format printing machine, comprising:

at least two offset printing apparatus (1), each apparatus comprising a frame (2) supporting a paper cylinder (5) against which a blanket cylinder (9) presses a blanket (11) to be printed, the printing ink being supplied on a plate cylinder (19) in contact with the blanket cylinder (9) by inking rollers, wherein, the paper cylinder (5) of each apparatus (1) is devoid of any drive in rotation and is substantially fixed with respect to the frame (2), and between two adjacent apparatus Cl) which print one and the same face of the blanket (11), the arrangement is such that this face is in contact only with the blanket cylinders (9), characterized in that each printing apparatus comprises sub-assemblies grouping together the elements respectively associated with the inking rollers (29), the plate cylinder (19) and the blanket cylinder (9), which are slidably mounted on slideways of the frame (2) under the action of motorization elements which are fast with the latter so that each of these sub-assemblies is adapted to undergo a translation perpendicular to the axis of rotation of the cylinders, and characterized in that each printing apparatus comprises detection and safety means allowing two sub-assemblies to move apart from each other when the detection means detect an effort greater than a determined maximum value between their respective associated cylinders.

12. Machine according to claim 11, characterized in that the safety means comprise a control logic for adjusting the offset of the cylinders with respect to one another.

13. Variable format printing machine, constituted by at least two offset printing apparatus (1), and comprising a frame (2) supporting a paper cylinder (5) against which a blanket cylinder (9) presses a blanket (11) to be printed, the printing ink being supplied on a plate cylinder (19) in contact with the blanket cylinder (9) by inking rollers, wherein, the paper cylinder (5) of each apparatus (1) is devoid of any drive in rotation and is substantially fixed with respect to the frame (2), between two adjacent apparatus (1) which print one and the same face of the blanket (11), the arrangement is such that this face is in contact only with the blanket cylinders (9), and the blanket cylinder (9) and/or the plate cylinder (19) and/or the inking rollers (29) are driven in rotation by independent motors electronically servo-controlled between themselves.

14. Machine according to claim 13, characterized in that the servo-control between themselves and with respect to the rest of the other elements of the machine of the drive motors is effected by a system of electric shafts.

15. Variable format printing machine, constituted by at least two offset printing apparatus (1), and comprising a frame (2) supporting a paper cylinder (5) against which a blanket cylinder (9) presses a blanket (11) to be printed, the printing ink being supplied on a plate cylinder (19) in contact with the blanket cylinder (9) by inking rollers, wherein, the paper cylinder (5) of each apparatus (1) is devoid of any drive in rotation and is substantially fixed with respect to the frame (2), between two adjacent apparatus (1) which print one and the same face of the blanket (11), the arrangement is such that this face is in contact only with the blanket cylinders (9), and at least one of the ends of at least one cylinder (9, 19) is maintained embedded in a bearing fast with the frame (2), the other end being, in position of operation, in abutment on a mobile support, this mobile support being retractable into rest position, so that, in this position, the cylinder can be maintained in overhang by the bearing.

16. Machine according to claim 15, characterized in that the mobile support comprises at least two abutments of one end of the cylinder and complementary abutment means applying the cylinder on these two abutments in order to hold it there.

17. Machine according to claim 16, characterized in that the mobile support is in the form of a U.

18. Machine according to claim 16, characterized in that the two abutments are constituted by rotating elements.

19. Machine according to claim 16, characterized in that the complementary abutment means are constituted by a pivoting lock controlled by a jack.

* * * * *